US009869046B2

(12) United States Patent
ChaoLong et al.

(10) Patent No.: US 9,869,046 B2
(45) Date of Patent: Jan. 16, 2018

(54) POLYESTER ACETATE TEAR-AWAY PRINTED LABEL AND METHODS OF MANUFACTURING

(71) Applicants: Zhang ChaoLong, Hong Kong (CN); Hershel Cherson, Yorba Linda, CA (US)

(72) Inventors: Zhang ChaoLong, Hong Kong (CN); Hershel Cherson, Yorba Linda, CA (US)

( * ) Notice: Subject to any disclaimer, the term of this patent is extended or adjusted under 35 U.S.C. 154(b) by 125 days.

(21) Appl. No.: 14/962,836

(22) Filed: Dec. 8, 2015

(65) Prior Publication Data

US 2016/0237600 A1 Aug. 18, 2016

(30) Foreign Application Priority Data

Feb. 13, 2015 (CN) ..... 2015 1 0076903

(51) Int. Cl.

| | |
|---|---|
| ***B05D 3/12*** | (2006.01) |
| ***D06B 1/00*** | (2006.01) |
| ***D03D 1/00*** | (2006.01) |
| ***D03D 15/00*** | (2006.01) |
| ***D06L 1/14*** | (2006.01) |
| ***D06M 11/38*** | (2006.01) |
| ***D06M 13/07*** | (2006.01) |
| ***D06M 15/05*** | (2006.01) |
| ***D06M 23/10*** | (2006.01) |
| *D06M 101/32* | (2006.01) |

(52) U.S. Cl.

CPC ..... *D06B 1/00* (2013.01); *D03D 1/00* (2013.01); *D03D 15/00* (2013.01); *D06L 1/14* (2013.01); *D06M 11/38* (2013.01); *D06M 13/07* (2013.01); *D06M 15/05* (2013.01); *D06M 23/10* (2013.01); *D06M 2101/32* (2013.01); *D10B 2331/04* (2013.01)

(58) Field of Classification Search

CPC ..... D06B 1/00; D03D 1/00; D03D 1/0011; D03D 15/00; D06M 13/07

See application file for complete search history.

(56) References Cited

U.S. PATENT DOCUMENTS

| | | | | |
|---|---|---|---|---|
| 2,664,409 | A * | 12/1953 | Munden | D06B 19/0082 106/243 |
| 2002/0146950 | A1* | 10/2002 | Reich | A41D 31/02 442/96 |
| 2009/0188142 | A1* | 7/2009 | Chamandy | B65C 5/00 40/625 |

FOREIGN PATENT DOCUMENTS

| | | | |
|---|---|---|---|
| CN | 201390723 | Y | 1/2010 |
| CN | 103572610 | A | 2/2014 |
| CN | 104164733 | A * | 7/2014 |

* cited by examiner

*Primary Examiner* — Kelly M Gambetta

(74) *Attorney, Agent, or Firm* — Entralta P.C.; Justin G. Sanders; Peter D. Weinstein

(57) ABSTRACT

A polyester acetate tear-away printed label and associated methods of manufacture are disclosed. In at least one embodiment, one such method of manufacture involves weaving a base cloth using polyester acetate filament yarns, sizing and oiling the base cloth, desizing and refining the base cloth using a jet grouting overflow machine having a low desizing bath ratio, performing an alkali peel on the base cloth, shaping and drying the base cloth, further shaping the base cloth, coating the base cloth, and slitting the base cloth into desired dimensions.

18 Claims, 1 Drawing Sheet

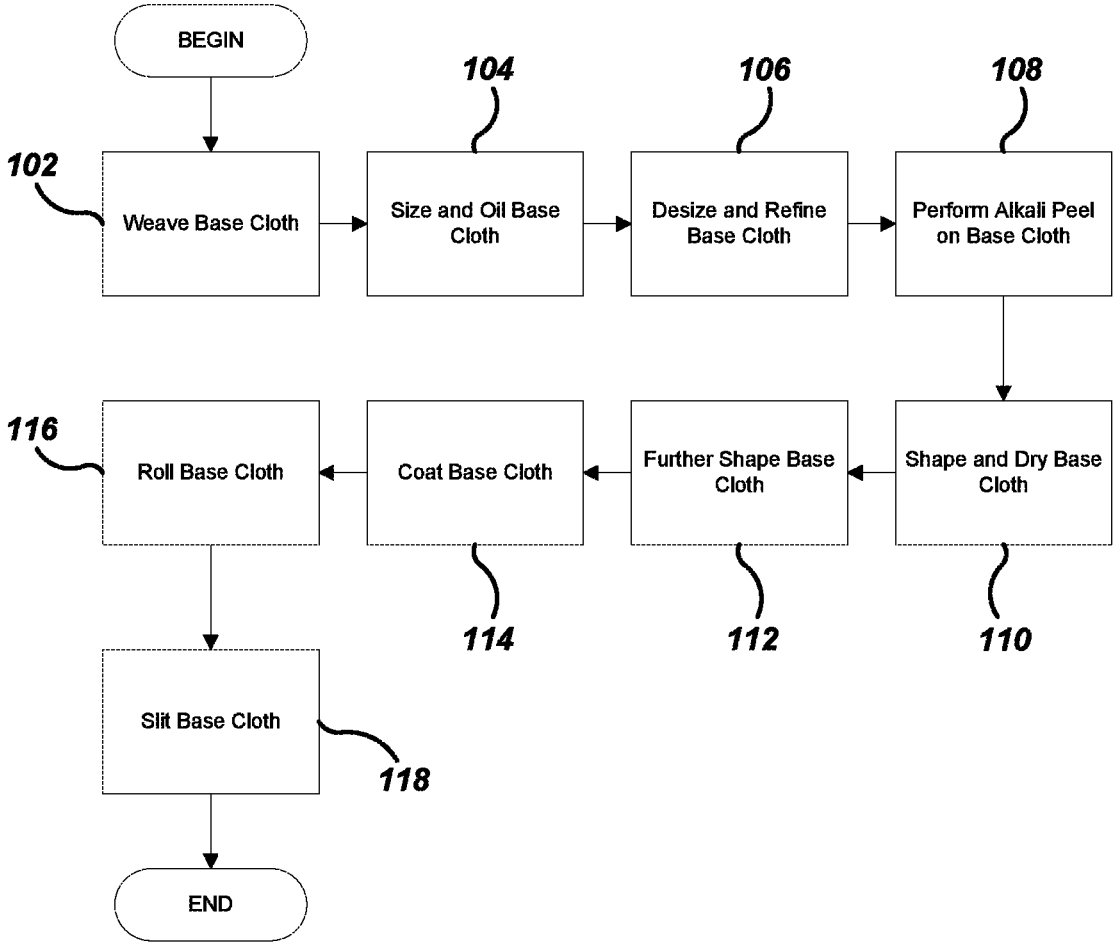
BEGIN
102
Weave Base Cloth
104
Size and Oil Base Cloth
106
Desize and Refine Base Cloth
108
Perform Alkali Peel on Base Cloth
110
Shape and Dry Base Cloth
112
Further Shape Base Cloth
114
Coat Base Cloth
116
Roll Base Cloth
118
Slit Base Cloth
END

POLYESTER ACETATE TEAR-AWAY PRINTED LABEL AND METHODS OF MANUFACTURING

RELATED APPLICATIONS

This application claims priority under 35 U.S.C. §119 and is entitled to the filing date of CN patent application serial number CN 2015-10076903.2, filed on Feb. 13, 2015. The contents of the aforementioned application are incorporated by reference herein.

BACKGROUND

The subject of this patent application relates generally to textiles, and more particularly to a polyester acetate tear-away printed label and associated methods of manufacturing.

Applicant(s) hereby incorporate herein by reference any and all patents and published patent applications cited or referred to in this application.

By way of background, a printed label is a label printed on a blank tape, and then is separately cut into a single piece for use. Compared with the traditional jacquard weaving manner, the production efficiency of printed labels is typically high and the cost is low. Although the printed label has high production efficiency and is accepted by most manufacturers, its technical requirements are very strict. If the production technology is not perfect, logo colors may fade, label edges may become frayed and damaged more easily, and excessive formaldehyde concentrations may remain in labels with extreme PH value or even contain substances that are harmful to human bodies.

Aspects of the present invention fulfill these needs and provide further related advantages as described in the following summary.

SUMMARY

Aspects of the present invention teach certain benefits in construction and use which give rise to the exemplary advantages described below.

The present invention solves the problems described above by providing a polyester acetate tear-away printed label, and associated methods of manufacturing, wherein polyester acetate filament yarns are used to produce the base cloth, so that the printed label is more environmentally friendly and the strength thereof is increased appropriately. In at least one embodiment, one such method of manufacture involves weaving a base cloth using polyester acetate filament yarns, sizing and oiling the base cloth, desizing and refining the base cloth using a jet grouting overflow machine having a low desizing bath ratio, performing an alkali peel on the base cloth, shaping and drying the base cloth, further shaping the base cloth, coating the base cloth, and slitting the base cloth into desired dimensions.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings:

FIG. 1 is a flow diagram illustrating an exemplary method of manufacturing a polyester acetate tear-away printed label, in accordance with at least one embodiment.

The above described drawing FIGURES illustrate aspects of the invention in at least one of its exemplary embodiments, which are further defined in detail in the following description. Features, elements, and aspects of the invention that are referenced by the same numerals in different FIGURES represent the same, equivalent, or similar features, elements, or aspects, in accordance with one or more embodiments.

DETAILED DESCRIPTION

In at least one embodiment, the present invention is a polyester acetate tear-away printed label, wherein the base cloth is produced from polyester acetate filament yarns having a gram weight of approximately 98-150 g, a pH value of 6-10, and a thickness of approximately 0.11-0.19 mm. In at least one embodiment, the warp yarn of the polyester acetate filament yarn is 75D/48F having a warp density of approximately 750-950 pieces per 10 cm, and the weft yarn thereof is 120D/72F having a weft density of approximately 280-380 pieces per 10 cm. In at least one further embodiment, the warp yarn may range from 75D/36F to 75D/24F having a warp density of approximately 580-920 pieces per 10 cm, and the weft yarn may range from 100D/72F to 140D/96F having a weft density of approximately 240-380 pieces per 10 cm. It should be noted that, in at least one embodiment, the tear-away printed labels described herein may be single-sided satin labels, double-sided satin labels, or double-sided pearl labels. Thus, the methods of manufacturing described herein should not be read as being limited one particular type of tear-away printed label even if certain types are expressly mentioned for illustrative purposes.

In at least one embodiment, the serial number of the single-sided satin tear-away printed label is ATS7511, wherein the warp yarn of the weave yarn is 75D/48F having a warp density of approximately 780 pieces per 10 cm, and the weft yarn is 120D/72F having a weft density of approximately 280-320 per 10 cm. In at least one embodiment, the serial number of the double-sided satin tear-away printed label is ATS7533S, with the raw materials selection thereof being the same as the single-sided satin tear-away printed label, but the weaving process is completely different; the warp yarn being 75D/48F having a warp density of approximately 948 pieces per 10 cm, and the weft yarn being 120D/72F having a weft density of approximately 378 pieces per 10 cm. In at least one embodiment, through common tensile breaking detection, the warp-wise breaking force of the tear-away printed label with single-sided satin is approximately 0.392N and the weft-wise breaking force thereof is approximately 1.764N. In at least one embodiment, the warp-wise breaking force of the tear-away printed label with double-sided satin is approximately 0.98N, and the weft-wise breaking force thereof is approximately 0.49N.

In at least one embodiment, the present invention further provides a method for manufacturing a polyester acetate tear-away printed label. In at least one such embodiment, as illustrated in the flow diagram of FIG. 1, the base cloth is first woven using polyester acetate filament yarns as raw materials (102), designing satin weave as the weaving structure using an air jet loom to weave the greige material, and then performing proper texturing to enable polyester fibers to react to light in a diffused manner. Use of an air jet loom assists in preventing the polyester acetate filament yarns from being exposed to a humid environment for a prolonged period which would affect the effect of the acetate. Additionally, in at least one embodiment, while the yarn is made of glazed acetate filament yarn, the warp yarn is 75D/48F having a warp density of approximately 780 pieces per 10 cm, and the weft yarn is 120D/72F having a weft density of approximately 280-320 pieces per 10 cm. In at least one further embodiment, the warp yarn is 75D/48F having a warp density of approximately 948 pieces per 10 cm, and the weft yarn is 120D/72F having a weft density of approximately 378 pieces per 10 cm.

In at least one embodiment, the base cloth is then sized and oiled (104). In at least one embodiment, during the weaving process described above, the warp yarn is sized and oiled in advance in order to better ensure the weaving continuity, reduce the chances of acetate filament breakage, and increase the smoothness of the surface of the warp yarn on the air jet loom.

In at least one embodiment, using a jet grouting overflow machine having a low bath ratio, the base cloth is desized and refined (106). In at least one such embodiment, a desizing bath of the jet grouting overflow machine has a pH value of 4-10 and contains approximately 2-4 g/L of a refining agent and approximately 2-6 g/L of sodium hydroxide (NaOH). Accordingly, in at least one embodiment, the bath ratio is 1:9-16. Additionally, in at least one embodiment, the desizing bath has a temperature of approximately 80-90 degrees Celsius, and the fabric is desized and refined for a duration of approximately 10-60 minutes per meter. In at least one embodiment, the sizing agent is a domestic, environmentally friendly sizing agent that does not cause any environmental pollution. In at least one further embodiment, the desizing bath has a pH value of 7.5 and contains 3 g/L of refining agent and 2.5 g/L of NaOH, with the bath ratio being 1:12, a temperature of 85 degrees Celsius, and the fabric is desized and refined for a duration of 22 minutes per meter. In at least one still further embodiment, the desizing bath has a pH value of 7 and contains 3.5 g/L of refining agent and 3 g/L of NaOH, with the bath ratio being 1:14, a temperature of 88 degrees Celsius, and the fabric is desized and refined for a duration of 20 minutes per meter.

In at least one embodiment, after the base cloth is desized and refined, an alkali peeling is performed on the base cloth (108). In at least one such embodiment, due to the polyester yarn having a relatively high degree of crystallinity, the crystalline regions and the non-crystalline regions are piled up closely, the hydrolysis reaction of the polyester is conducted unevenly in the event of alkali peeling, and the polyester gradually penetrates inward from the fiber surface and the non-crystalline regions, such that the fiber surface is subject to alkali corrosion to form a worm-eaten shape or even crack, and react to light in a diffused manner, resulting in a relatively soft glossy look. Meanwhile, the junction of the yarns absorbs more caustic soda liquid which reduces the interweaving resistance. The weave structure becomes loose and less rigid, thereby increasing the drape degree. Therefore, the alkali peeling should be selected reasonably. If the alkali peeling rate is too high, the drape degree and fabric flexibility would be increased, but the fabric strength would be reduced and result in poor quality. Alternatively, if the alkali peeling rate is too low, the fabric becomes less desirable to the touch. Thus, in at least one embodiment, the alkali peeling process preferably utilizes approximately 60-150 g/L of 3.5% NaOH having a temperature of approximately 60-100 degrees Celsius for a duration of approximately 20-60 minutes per meter. In at least one further embodiment, the alkali peeling process utilizes 120 g/L of 3.5% NaOH having a temperate of 85 degrees Celsius for a duration of 35 minutes per meter. In at least one still further embodiment, the alkali peeling process utilizes 130 g/L of 3.5% NaOH having a temperate of 88 degrees Celsius for a duration of 37 minutes per meter.

In at least one embodiment, the base cloth is then shaped and dried (110). In at least one such embodiment, the polyester fiber has high crystallinity, and the crystalline regions and non-crystalline regions thereof are arranged closely. The crystalline regions and non-crystalline regions of the polyester can be arranged orderly through shaping, which can effectively improve the uniformity of dyeing and alkali peeling, as well as enhancing the flatness and wrinkle resistance of the fabric surface. If the shaping temperature is too high, the fabric will become hard which will affect the feeling of the fabric to the touch; while if the temperature is too low, the wrinkle resistance of the fabric is weak, which also will affect the dyeing uniformity of the fabric. Thus, in at least one embodiment, the base cloth is preferably shaped and dried at a temperature of approximately 140-215 degrees Celsius for a duration of approximately 30-40 minutes per meter. In at least one further embodiment, the base cloth is shaped and dried at a temperature of 170 degrees Celsius for a duration of 35 minutes per meter. In at least one still further embodiment, the base cloth is shaped and dried at a temperature of 175 degrees Celsius for a duration of 38 minutes per meter. After drying, a finishing agent for moisture absorption and sweat releasing, followed by an anti-pilling finishing agent, are used for arrangement.

In at least one embodiment, the base cloth is shaped again (112) before coating (114) and rolled into large rolls (116) under a high temperature of approximately 160-180 degrees Celsius for a duration of approximately 30-50 minutes per meter, and this serves as a treatment before coating. In at least one further embodiment, the base cloth is shaped under a temperature of 170 degrees Celsius for a duration of 40 minutes per meter.

In at least one embodiment, during the coating treatment (114), the single-sided satin tear-away printed label uses a mixture of approximately 11.6-15.8 g/m$^2$ of a water-soluble PA hard pulp, 11.6-15.8 g/m$^2$ of a PA soft pulp, 5-7 g/m$^2$ of a white pulp, 1-2 g/m$^2$ of a cross linking agent, and 1-2.5 g/m$^2$ of a thickening agent. In at least one further embodiment, a mixture of approximately 13.61 g/m$^2$ of a water-soluble PA hard pulp, 13.67 g/m$^2$ of a PA soft pulp, 6.84 g/m$^2$ of a white pulp, 1.54 g/m$^2$ of a cross linking agent and 1.88 g/m$^2$ of a thickening agent is used. In at least one such embodiment, these raw materials are environmentally-friendly, but the production quantity must be controlled, so as to enhance the product quality, improving the visual appearance and the feel of the fabric to the touch. In at least one embodiment, the double-sided satin tear-away printed label uses the same raw materials as the single-sided satin tear-away label and ATS7533S weave yarn number, wherein the warp yarn is 75D/48F having a warp density of approximately 948 pieces per 10 cm, and the weft yarn is 120D/72F having a weft density of approximately 378 pieces per 10 cm. The double-sided pearl tear-away label uses approximately 16-23 g/m$^2$ of FS5030 solvent PC, 8-15 g/m$^2$ of an environmentally-friendly methylbenzene, and 2.5-4 g/m$^2$ of 200-crystal white pearl powder (having a No. of 81400). In at least one further embodiment, approximately 20 g/m$^2$ of FS5030 solvent PC, 11 g/m$^2$ of an environmentally-friendly methylbenzene, and 3.125 g/m$^2$ of 200-crystal white pearl powder (having a No. of 81400) is used.

In at least one embodiment, the base cloth is slit (118) in accordance with the specifications of a given customer at a temperature of approximately 170-200 degrees Celsius for a duration of 30-40 minutes per meter. In at least one further embodiment, the base cloth is slit at a temperature of 180 degrees Celsius for a duration of 35 minutes per meter. In at least one still further embodiment, the base cloth is slit at a temperature of 190 degrees Celsius for a duration of 37 minutes per meter.

As a result, in at least one embodiment, the base cloth will have a better whiteness, and will have firmer edges along both sides thereof. Additionally, the printed label is more environmentally friendly and the strength thereof is increased appropriately.

Aspects of the present specification may also be described as follows:

1. A method for manufacturing a polyester acetate tear-away printed label comprising the steps of: weaving a base cloth using polyester acetate filament yarns; sizing and oiling the base cloth; desizing and refining the base cloth using a jet grouting overflow machine having a low desizing bath ratio; performing an alkali peel on the base cloth; shaping and drying the base cloth; further shaping the base cloth; coating the base cloth; and slitting the base cloth into desired dimensions.

2. The method according to embodiment 1, wherein the step of weaving a base cloth using polyester acetate filament yarns further comprises the step of weaving a base cloth using polyester acetate filament yarns having a weight of 98-150 grams, a pH value of 6-10, and a thickness of 0.11-0.19 millimeters.

3. The method according to embodiments 1-2, wherein the step of weaving a base cloth using polyester acetate filament yarns further comprises the step of weaving a base cloth using polyester acetate filament yarns with a warp yarn of the polyester acetate filament yarn being 75D/48F and having a warp density of 750-950 pieces per 10 centimeters, and a weft yarn of the polyester acetate filament yarn being 120D/72F and having a weft density of 280-380 pieces per 10 centimeters.

4. The method according to embodiments 1-3, wherein the step of weaving a base cloth further comprises the steps of: designing satin weave as the weaving structure; using an air jet loom to weave the greige material; and performing proper texturing to enable polyester fibers to reflect to light In a diffused manner.

5. The method according to embodiments 1-4, further comprising the step of sizing and oiling a warp yarn of the base cloth prior to weaving the base cloth.

6. The method according to embodiments 1-5, wherein the step of desizing and refining the base cloth using a jet grouting overflow machine further comprises the step of using a desizing bath having a pH value of 4-10 and containing 2-4 grams per liter of a refining agent and 2-6 grams per liter of sodium hydroxide.

7. The method according to embodiments 1-6, further comprising the step of using a desizing bath having a temperature of 80-90 degrees Celsius.

8. The method according to embodiments 1-7, further comprising the step of desizing and refining the base cloth for a duration of 10-60 minutes per meter.

9. The method according to embodiments 1-8, further comprising the step of using a desizing bath having a pH value of 7.5, a temperature of 85 degrees Celsius, and containing 3 grams per liter of the refining agent and 2.5 grams per liter of sodium hydroxide, for a duration of 22 minutes per meter.

10. The method according to embodiments 1-9, further comprising the step of using a desizing bath having a pH value of 7, a temperature of 88 degrees Celsius, and containing 3.5 grams per liter of the refining agent and 3 grams per liter of sodium hydroxide, for a duration of 20 minutes per meter.

11. The method according to embodiments 1-10, wherein the step of performing an alkali peel on the base cloth further comprises the step of performing an alkali peel on the base cloth using 60-150 grams per liter of 3.5% sodium hydroxide having a temperature of 60-100 degrees Celsius for a duration of 20-60 minutes per meter.

12. The method according to embodiments 1-11, further comprising the step of performing an alkali peel on the base cloth using 120 grams per liter of 3.5% sodium hydroxide having a temperature of 85 degrees Celsius for a duration of 35 minutes per meter.

13. The method according to embodiments 1-12, further comprising the step of performing an alkali peel on the base cloth using 130 grams per liter of 3.5% sodium hydroxide having a temperature of 88 degrees Celsius for a duration of 37 minutes per meter.

14. The method according to embodiments 1-13, wherein the step of shaping and drying the base cloth further comprises the step of shaping and drying the base cloth at a temperature of 140-215 degrees Celsius for a duration of 30-40 minutes per meter.

15. The method according to embodiments 1-14, further comprising the step of shaping and drying the base cloth at a temperature of 170 degrees Celsius for a duration of 35 minutes per meter.

16. The method according to embodiments 1-15, further comprising the step of shaping and drying the base cloth at a temperature of 175 degrees Celsius for a duration of 38 minutes per meter.

17. The method according to embodiments 1-16, further comprising the step of applying a moisture absorption finishing agent to the base cloth.

18. The method according to embodiments 1-17, further comprising the step of applying an anti-pilling finishing agent to the base cloth.

19. The method according to embodiments 1-18, wherein the step of further shaping the base cloth further comprises the step of further shaping the base cloth at a temperature of 160-180 degrees Celsius for a duration of 30-50 minutes per meter.

20. The method according to embodiments 1-19, further comprising the step of further shaping the base cloth at a temperature of 170 degrees Celsius for a duration of 40 minutes per meter.

21. The method according to embodiments 1-20, wherein the step of coating the base cloth further comprises the step of coating the base cloth with a mixture of 11.6-15.8 grams per square meter of a water-soluble PA hard pulp, 11.6-15.8 grams per square meter of a PA soft pulp, 5-7 grams per square meter of a white pulp, 1-2 grams per square meter of a cross linking agent, and 1-2.5 grams per square meter of a thickening agent.

22. The method according to embodiments 1-21, further comprising the step of coating the base cloth with a mixture of 13.61 grams per square meter of a water-soluble PA hard pulp, 13.67 grams per square meter of a PA soft pulp, 6.84 grams per square meter of a white pulp, 1.54 grams per square meter of a cross linking agent and 1.88 grams per square meter of a thickening agent.

23. The method according to embodiments 1-22, further comprising the step of coating the base cloth with a further mixture of 16-23 grams per square meter of FS5030 solvent PC, 8-15 grams per square meter of methylbenzene, and 2.5-4 grams per square meter of 200-crystal white pearl powder.

24. The method according to embodiments 1-23, further comprising the step of coating the base cloth with a further mixture of 20 grams per square meter of FS5030 solvent PC, 11 grams per square meter of methylbenzene, and 3.125 grams per square meter of 200-crystal white pearl powder.

25. The method according to embodiments 1-24, further comprising the step of rolling the base cloth into an at least one large roll.

26. The method according to embodiments 1-25, wherein the step of slitting the base cloth into desired dimensions further comprises the step of slitting the base cloth at a temperature of 170-200 degrees Celsius for a duration of 30-40 minutes per meter.

27. The method according to embodiments 1-26, further comprising the step of slitting the base cloth at a temperature of 180 degrees Celsius for a duration of 35 minutes per meter.

28. The method according to embodiments 1-27, further comprising the step of slitting the base cloth at a temperature of 190 degrees Celsius for a duration of 37 minutes per meter.

29. A method for manufacturing a polyester acetate tear-away printed label comprising the steps of: weaving a base cloth using polyester acetate filament yarns having a weight of 98-150 grams, a pH value of 6-10, and a thickness of 0.11-0.19 millimeters; sizing and oiling the base cloth; desizing and refining the base cloth using a jet grouting overflow machine and a desizing bath having a pH value of 4-10, a temperature of 80-90 degrees Celsius, and containing 2-4 grams per liter of a refining agent and 2-6 grams per liter of sodium hydroxide for a duration of 10-60 minutes per meter; performing an alkali peel on the base cloth using 60-150 grams per liter of 3.5% sodium hydroxide having a temperature of 60-100 degrees Celsius for a duration of 20-60 minutes per meter; shaping and drying the base cloth at a temperature of 140-215 degrees Celsius for a duration of 30-40 minutes per meter; coating the base cloth with a mixture of 11.6-15.8 grams per square meter of a water-soluble PA hard pulp, 11.6-15.8 grams per square meter of a PA soft pulp, 5-7 grams per square meter of a white pulp, 1-2 grams per square meter of a cross linking agent, and 1-2.5 grams per square meter of a thickening agent; rolling the base cloth into an at least one large roll; and slitting the base cloth into desired dimensions at a temperature of 170-200 degrees Celsius for a duration of 30-40 minutes per meter.

30. A method for manufacturing a polyester acetate tear-away printed label comprising the steps of: weaving a base cloth using polyester acetate filament yarns having a weight of 98-150 grams, a pH value of 6-10, and a thickness of 0.11-0.19 millimeters, a warp yarn of the polyester acetate filament yarn being 75D/48F and having a warp density of 750-950 pieces per 10 centimeters, and a weft yarn of the polyester acetate filament yarn being 120D/72F and having a weft density of 280-380 pieces per 10 centimeters; sizing and oiling the base cloth; desizing and refining the base cloth using a jet grouting overflow machine and a desizing bath having a pH value of 4-10, a temperature of 80-90 degrees Celsius, and containing 2-4 grams per liter of a refining agent and 2-6 grams per liter of sodium hydroxide for a duration of 10-60 minutes per meter; performing an alkali peel on the base cloth using 60-150 grams per liter of 3.5% sodium hydroxide having a temperature of 60-100 degrees Celsius at a spped of 20-60 minutes per meter; shaping and drying the base cloth at a temperature of 140-215 degrees Celsius for a duration of 30-40 minutes per meter; further shaping the base cloth at a temperature of 160-180 degrees Celsius for a duration of 30-50 minutes per meter; coating the base cloth with a mixture of 11.6-15.8 grams per square meter of a water-soluble PA hard pulp, 11.6-15.8 grams per square meter of a PA soft pulp, 5-7 grams per square meter of a white pulp, 1-2 grams per square meter of a cross linking agent, and 1-2.5 grams per square meter of a thickening agent; coating the base cloth with a further mixture of 16-23 grams per square meter of FS5030 solvent PC, 8-15 grams per square meter of methylbenzene, and 2.5-4 grams per square meter of 200-crystal white pearl powder; rolling the base cloth into an at least one large roll; and slitting the base cloth into desired dimensions at a temperature of 170-200 degrees Celsius for a duration of 30-40 minutes per meter.

In closing, regarding the exemplary embodiments of the present invention as shown and described herein, it will be appreciated that a polyester acetate tear-away printed label and associated methods of manufacturing are disclosed. Because the principles of the invention may be practiced in a number of configurations beyond those shown and described, it is to be understood that the invention is not in any way limited by the exemplary embodiments, but is generally directed to a polyester acetate tear-away printed label and is able to take numerous forms to do so without departing from the spirit and scope of the invention. It will also be appreciated by those skilled in the art that the present invention is not limited to the particular geometries and materials of construction disclosed, but may instead entail other functionally comparable structures or materials, now known or later developed, without departing from the spirit and scope of the invention. Furthermore, the various features of each of the above-described embodiments may be combined in any logical manner and are intended to be included within the scope of the present invention.

Groupings of alternative embodiments, elements, or steps of the present invention are not to be construed as limitations. Each group member may be referred to and claimed individually or in any combination with other group members disclosed herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Unless otherwise indicated, all numbers expressing a characteristic, item, quantity, parameter, property, term, and so forth used in the present specification and claims are to be understood as being modified in all instances by the term "about." As used herein, the term "about" means that the characteristic, item, quantity, parameter, property, or term so qualified encompasses a range of plus or minus ten percent above and below the value of the stated characteristic, item, quantity, parameter, property, or term. Accordingly, unless indicated to the contrary, the numerical parameters set forth in the specification and attached claims are approximations that may vary. At the very least, and not as an attempt to limit the application of the doctrine of equivalents to the scope of the claims, each numerical indication should at least be construed in light of the number of reported significant digits and by applying ordinary rounding techniques. Notwithstanding that the numerical ranges and values setting forth the broad scope of the invention are approximations, the numerical ranges and values set forth in the specific examples are reported as precisely as possible. Any numerical range or value, however, inherently contains certain errors necessarily resulting from the standard deviation found in their respective testing measurements. Recitation of numerical ranges of values herein is merely intended to serve as a shorthand method of referring individually to each separate numerical value falling within the range. Unless otherwise indicated herein, each individual value of a numerical range is incorporated into the present specification as if it were individually recited herein.

The terms "a," "an," "the" and similar references used in the context of describing the present invention (especially in the context of the following claims) are to be construed to cover both the singular and the plural, unless otherwise indicated herein or clearly contradicted by context. Further, ordinal indicators—such as "first," "second," "third," etc.—for identified elements are used to distinguish between the elements, and do not indicate or imply a required or limited number of such elements, and do not indicate a particular position or order of such elements unless otherwise specifically stated. All methods described herein can be performed in any suitable order unless otherwise indicated herein or otherwise clearly contradicted by context. The use of any and all examples, or exemplary language (e.g., "such as") provided herein is intended merely to better illuminate the present invention and does not pose a limitation on the scope of the invention otherwise claimed. No language in the present specification should be construed as indicating any non-claimed element essential to the practice of the invention.

Specific embodiments disclosed herein may be further limited in the claims using consisting of or consisting essentially of language. When used in the claims, whether as filed or added per amendment, the transition term "consisting of" excludes any element, step, or ingredient not specified in the claims. The transition term "consisting essentially of" limits the scope of a claim to the specified materials or steps and those that do not materially affect the basic and novel characteristic(s). Embodiments of the present invention so claimed are inherently or expressly described and enabled herein.

It should be understood that the processes and methods, and the order in which the respective elements of each method are performed, are purely exemplary. Depending on the implementation, they may be performed in any order or in parallel, unless indicated otherwise in the present disclosure.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A method for manufacturing a polyester acetate tear-away printed label comprising the steps of:

weaving a base cloth using polyester acetate filament yarns;

sizing and oiling the base cloth;

desizing and refining the base cloth using a jet grouting overflow machine having a low desizing bath ratio;

performing an alkali peel on the base cloth;

shaping and drying the base cloth;

further shaping the base cloth;

coating the base cloth with a mixture of 11.6-15.8 grams per square meter of a water-soluble PA hard pulp, 11.6-15.8 grams per square meter of a PA soft pulp, 5-7 grams per square meter of a white pulp, 1-2 grams per square meter of a cross linking agent, and 1-2.5 grams per square meter of a thickening agent; and slitting the base cloth into desired dimensions.

2. The method of claim 1, wherein the step of weaving a base cloth using polyester acetate filament yarns further comprises the step of weaving a base cloth using polyester acetate filament yarns having a weight of 98-150 grams, a pH value of 6-10, and a thickness of 0.11-0.19 millimeters.

3. The method of claim 1, wherein the step of weaving a base cloth using polyester acetate filament yarns further comprises the step of weaving a base cloth using polyester acetate filament yarns with a warp yarn of the polyester acetate filament yarn being 75D/48F and having a warp density of 750-950 pieces per 10 centimeters, and a weft yarn of the polyester acetate filament yarn being 120D/72F and having a weft density of 280-380 pieces per 10 centimeters.

4. The method of claim 1, wherein the step of weaving a base cloth further comprises the steps of:

designing satin weave as the weaving structure;

using an air jet loom to weave the greige material; and performing proper texturing to enable polyester fibers to react to light in a diffused manner.

5. The method of claim 1, further comprising the step of sizing and oiling a warp yarn of the base cloth prior to weaving the base cloth.

6. The method of claim 1, wherein the step of desizing and refining the base cloth using a jet grouting overflow machine further comprises the step of using a desizing bath having a pH value of 4-10 and containing 2-4 grams per liter of a refining agent and 2-6 grams per liter of sodium hydroxide.

7. The method of claim 6, further comprising the step of using a desizing bath having a temperature of 80-90 degrees Celsius.

8. The method of claim 6, further comprising the step of desizing and refining the base cloth for a duration of 10-60 minutes per meter.

9. The method of claim 1, wherein the step of performing an alkali peel on the base cloth further comprises the step of performing an alkali peel on the base cloth using 60-150 grams per liter of 3.5% sodium hydroxide having a temperature of 60-100 degrees Celsius for a duration of 20-60 minutes per meter.

10. The method of claim 1, wherein the step of shaping and drying the base cloth further comprises the step of shaping and drying the base cloth at a temperature of 140-215 degrees Celsius for a duration of 30-40 minutes per meter.

11. The method of claim 1, further comprising the step of applying a moisture absorption finishing agent to the base cloth.

12. The method of claim 1, further comprising the step of applying an anti-pilling finishing agent to the base cloth.

13. The method of claim 1, wherein the step of further shaping the base cloth further comprises the step of further shaping the base cloth at a temperature of 160-180 degrees Celsius for a duration of 30-50 minutes per meter.

14. The method of claim 1, further comprising the step of coating the base cloth with a further mixture of 16-23 grams per square meter of FS5030 solvent PC, 8-15 grams per square meter of methylbenzene, and 2.5-4 grams per square meter of 200-crystal white pearl powder.

15. The method of claim 1, further comprising the step of rolling the base cloth into an at least one large roll.

16. The method of claim 1, wherein the step of slitting the base cloth into desired dimensions further comprises the step of slitting the base cloth at a temperature of 170-200 degrees Celsius for a duration of 30-40 minutes per meter.

17. A method for manufacturing a polyester acetate tear-away printed label comprising the steps of:

weaving a base cloth using polyester acetate filament yarns having a weight of 98-150 grams, a pH value of 6-10, and a thickness of 0.11-0.19 millimeters;

sizing and oiling the base cloth;

desizing and refining the base cloth using a jet grouting overflow machine and a desizing bath having a pH value of 4-10, a temperature of 80-90 degrees Celsius, and containing 2-4 grams per liter of a refining agent and 2-6 grams per liter of sodium hydroxide for a duration of 10-60 minutes per meter;

performing an alkali peel on the base cloth using 60-150 grams per liter of 3.5% sodium hydroxide having a temperature of 60-100 degrees Celsius for a duration of 20-60 minutes per meter;

shaping and drying the base cloth at a temperature of 140-215 degrees Celsius for a duration of 30-40 minutes per meter;

coating the base cloth with a mixture of 11.6-15.8 grams per square meter of a water-soluble PA hard pulp, 11.6-15.8 grams per square meter of a PA soft pulp, 5-7 grams per square meter of a white pulp, 1-2 grams per square meter of a cross linking agent, and 1-2.5 grams per square meter of a thickening agent;

rolling the base cloth into an at least one large roll; and slitting the base cloth into desired dimensions at a temperature of 170-200 degrees Celsius for a duration of 30-40 minutes per meter.

18. A method for manufacturing a polyester acetate tear-away printed label comprising the steps of:

weaving a base cloth using polyester acetate filament yarns having a weight of 98-150 grams, a pH value of 6-10, and a thickness of 0.11-0.19 millimeters, a warp yarn of the polyester acetate filament yarn being 75D/48F and having a warp density of 750-950 pieces per 10 centimeters, and a weft yarn of the polyester acetate filament yarn being 120D/72F and having a weft density of 280-380 pieces per 10 centimeters;

sizing and oiling the base cloth;

desizing and refining the base cloth using a jet grouting overflow machine and a desizing bath having a pH value of 4-10, a temperature of 80-90 degrees Celsius, and containing 2-4 grams per liter of a refining agent and 2-6 grams per liter of sodium hydroxide for a duration of 10-60 minutes per meter;

performing an alkali peel on the base cloth using 60-150 grams per liter of 3.5% sodium hydroxide having a temperature of 60-100 degrees Celsius for a duration of 20-60 minutes per meter;

shaping and drying the base cloth at a temperature of 140-215 degrees Celsius for a duration of 30-40 minutes per meter;

further shaping the base cloth at a temperature of 160-180 degrees Celsius for a duration of 30-50 minutes per meter;

coating the base cloth with a mixture of 11.6-15.8 grams per square meter of a water-soluble PA hard pulp, 11.6-15.8 grams per square meter of a PA soft pulp, 5-7 grams per square meter of a white pulp, 1-2 grams per square meter of a cross linking agent, and 1-2.5 grams per square meter of a thickening agent;

coating the base cloth with a further mixture of 16-23 grams per square meter of FS5030 solvent PC, 8-15 grams per square meter of methylbenzene, and 2.5-4 grams per square meter of 200-crystal white pearl powder;

rolling the base cloth into an at least one large roll; and slitting the base cloth into desired dimensions at a temperature of 170-200 degrees Celsius for a duration of 30-40 minutes per meter.

* * * * *